United States Patent [19]

Baugh

[11] Patent Number: 4,497,368

[45] Date of Patent: Feb. 5, 1985

[54] HANGER MECHANISM

[75] Inventor: John L. Baugh, Huntsville, Tex.

[73] Assignee: Hughes Tool Company, Houston, Tex.

[21] Appl. No.: 592,737

[22] Filed: Mar. 23, 1984

Related U.S. Application Data

[63] Continuation of Ser. No. 402,387, Jul. 27, 1982, abandoned.

[51] Int. Cl.[3] ..... E21B 23/00

[52] U.S. Cl. ..... 166/208; 166/217

[58] Field of Search ..... 166/118, 209–211, 166/208, 206, 212, 213, 216, 217, 138–140, 134

[56] References Cited

U.S. PATENT DOCUMENTS

| | | | |
|---|---|---|---|
| 276,116 | 4/1883 | Williamson | 166/118 |
| 2,053,065 | 9/1936 | Crowell | 103/219 |
| 2,076,313 | 4/1937 | Zschokke | 166/217 |
| 2,427,330 | 9/1947 | Spencer | 166/208 |
| 2,649,914 | 8/1953 | Otis | 166/217 |
| 2,735,497 | 2/1956 | Brumleu et al. | 166/212 |
| 2,822,875 | 2/1958 | Brown | 166/138 |
| 3,195,646 | 7/1965 | Brown | 166/208 |
| 3,223,170 | 12/1965 | Mott | 166/208 |
| 3,291,220 | 12/1966 | Mott | 166/208 |
| 3,608,634 | 9/1971 | Cochran | 166/208 |
| 4,047,565 | 9/1977 | Crickmer | 166/217 |
| 4,085,804 | 4/1978 | Page, Jr. | 166/217 |
| 4,096,913 | 6/1978 | Kenneday et al. | 166/290 |
| 4,151,876 | 5/1979 | Briggs et al. | 166/134 |
| 4,249,601 | 2/1981 | White | 166/208 |

*Primary Examiner*—James A. Leppink
*Assistant Examiner*—Hoang C. Dang
*Attorney, Agent, or Firm*—Robert A. Felsman; Charles D. Gunter, Jr.

[57] ABSTRACT

A universal liner hanger apparatus is shown for hanging a liner in a well bore which has a universal body having upper and lower connecting ends. A hanger mechanism including a plurality of gripping slips and slip expanders are carried on the tubular body for engaging the well bore casing. Interchangeable setting mechanisms can be connected to a selected one of the upper and lower connecting ends and are actuable to engage the gripping slips with the slip expanders responsive to each of mechanical manipulation and fluid pressure. A single universal body is used with each of the different setting mechanisms to make-up the universal liner hanger apparatus. The hanger mechanism shown includes a plurality of longitudinal bars of single piece construction with spaced slip elements integrally formed therein. The longitudinal bars include a guide portion adapted to be slidingly received within guide tracks formed in selected ones of the expanders on the exterior of the tubular body. Sliding movement of the guide portions within the respective guide tracks causes the spaced slip elements to ride over the slip expanders to move the slip elements radially outward to engage the well bore.

4 Claims, 11 Drawing Figures

HANGER MECHANISM

BACKGROUND OF THE INVENTION

CROSS-REFERENCE TO RELATED APPLICATIONS

This case is related to the copending application of James W. Montgomery and John Lindley Baugh entitled "Universal Liner Hanger Apparatus". This application is a continuation of Ser. No. 402,388 filed July 27, 1982, now abandoned.

FIELD OF THE INVENTION

This invention relates generally to well completion equipment and techniques and specifically to a universal liner hanger apparatus for hanging a liner in a well bore and a hanger mechanism therefor.

PRIOR ART

A liner is a section of casing or tubing which is suspended in a well without normally extending to the surface. Liners are used for many purposes including well control and reducing the initial cost of casing. Liners may be installed entirely within outer casing strings or partially within the casing and partially within an open hole.

In one type of liner hanging operation, the liner is set or hung by first lowering the liner and a setting tool connected to an operating string into the well bore. The liner is hung, usually on slips, and the setting tool is usually then released from the liner.

Prior liner hanger tools are also known which utilize reciprocating motion between an outer tubular sleeve and an inner tubular body. The hanger slips are retracted as long as dog springs attached to the slips are restrained by a stop. Upon reaching the setting depth, the hanger tubular body is raised enough to engage the dog springs on a sliding trip ring. The tubular body is then lowered, causing the dog springs to move over both the trip ring and the stop. The greater relative movement allowed by the dog springs riding over the stop causes the slips to move along cone segments and wedge against the casing to support the liner.

In U.S. Pat. No. 3,195,646 to C. C. Brown, issued July 20, 1965, a liner hanger is shown in which a pin on the tubular body is carried in a J-shaped slot on the outer tubular sleeve. By lifting and rotating the tubing string at the surface, the pin can be manipulated in the J-shaped slot, thereby allowing relative movement between the sleeve and tubular body to activate the slip setting mechanism.

In drilling and completing wells in offshore areas, particularly where operations are conducted from a floating vessel as is now frequently done, the operating string is necessarily subjected to vertical movements due to the rise and fall of the vessel from which the operations are conducted. As a result, it is difficult to utilize mechanical manipulation of the operating string in setting of liners since vertical pushing and pulling movements, when using the reciprocation set and J-pin type setting mechanism, may result in premature setting of the liner hanger and other difficulties. U.S. Pat. No. 3,223,170 to James D. Mott, issued Dec. 14, 1965, shows a hydraulic pressure-set liner hanger designed to reduce the necessity of mechanical manipulation of the drill string. In the hydraulic setting mechanism, a hydraulic piston actuated by pressure in the tubing string engages the liner setting mechanism to set the slips. U.S. Pat. Nos. 3,291,220 to James D. Mott, issued Dec. 13, 1966, and 3,608,634 to Chudleigh B. Cochran, issued Sept. 28, 1971, also show hydraulically actuated liner hanger tools.

Prior liner hanger tools generally lacked versatility in that each tool was unique and designed to meet a particular need or operating condition. Thus, the hydraulically set liner hanger tool did not normally operate by mechanical manipulation or vice-versa. In addition to lacking versatility, there were few common parts between liner hanger tool designs thereby increasing the manufacturing costs and inventory requirements.

There exists a need for a universal tool which can be adapted to be set by any of the conventional methods and which has fewer specialized parts to stock.

SUMMARY OF THE INVENTION

The present invention is a universal liner hanger apparatus for hanging a liner in a well bore casing which includes an elongated tubular body having upper connecting means on the upper end thereof and lower connecting means on the lower end thereof. Expander means are carried on the tubular body. Gripping means carried on the tubular body are engageable with the expander means for shifting the gripping means into gripping engagement with the well bore casing. Interchangeable setting means are provided which are adapted to engage a selected one of the upper and lower connecting means. The interchangeable setting means are actuable to engage the gripping means with the expander means responsive to each of mechanical manipulation and fluid pressure.

Preferably, the expander means comprises a plurality of longitudinally spaced sets of conically shaped cone elements extending circumferentially around the exterior of the tubular body. The gripping means comprises a plurality of interconnected slip elements having outwardly protruding teeth thereon for gripping engagement on the casing. Preferably, the interchangeable setting means is actuable to engage the gripping means with the expander means responsive to actuation by a mechanism selected of the group consisting of a reciprocating sleeve, a hydraulic piston, a J-pin, and a setting tool.

Most preferably, the gripping means is a plurality of longitudinal bars having spaced integrally formed slip elements, each of the longitudinal bars having a guide portion adapted to be received within guide tracks formed in selected ones of the conically shaped cone elements on the exterior of the tubular body. Each longitudinal bar is provided with connectors at either end thereof for connection to a selected one of the interchangeable setting means to move the slip elements along the conically shaped cone elements to engage the casing.

Additional objects, features, and advantages will be apparent in the description which follows.

DETAILED DESCRIPTION OF THE INVENTION

Figure 1:
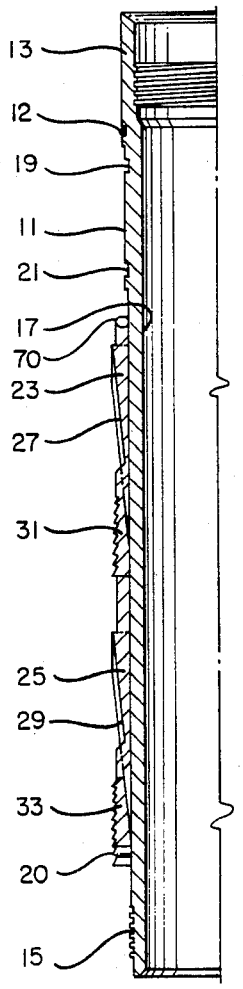
FIG. 1 is a side, partial cross-sectional view of the universal liner hanger tubular body, expander means and gripping means of the invention.

Turning now to FIG. 1, there is shown a portion of a universal liner hanger tool of the type used for hanging a liner in a well bore casing. The liner hanger tool includes an elongated tubular body 11 having an internally threaded upper end 13 and an externally threaded lower end 15 at the opposite end thereof. The upper external surface of elongated tubular body 11 is provided with an O-ring groove 12 and upper and lower circumferential grooves 19, 21 respectively adapted for receiving a suitable liner tie back sleeve/liner tie back setting sleeve as will be more fully described later. The circumferential grooves 19, 21, internally threaded upper end 13 and externally threaded lower end 15 comprise upper and lower connecting means, respectively, for connecting the tubular body 11 in a pipe string to make-up the universal liner hanger tool as will be presently described. Tubular body 11 has an internal bore 17 which communicates between ends 13, 15 of the body 11 for conducting well fluids and the like.

Formed on the external surface of the body 11 below lower circumferential groove 21 are a plurality of longitudinally spaced slip expander means 27, 29 (see FIG. 6). Slip expander means, 27, 29 preferably comprise two longitudinally spaced sets of conically-spaced cone elements having inwardly sloping surfaces 24, 26 made to co-operably engage upper and lower sets of toothed pipe-gripping wedges or slips 31, 33. Slips 31, 33 are carried on body 11 and are engageable with expander means 27, 29 for shifting the gripping slips 31, 33 radially outwardly into gripping engagement with the surrounding well casing in response to relative longitudinal movement between the expander means and the related slips.

As shown in FIG.'s 6 and 6A, the expander means or cones 27, 29 can be provided as longitudinally spaced sets on tubular body 11, each set having three cones located 120 degrees apart at each of two locations along the longitudinal axis of the tubular body 11. The cones 27, 29 are stationary and can be milled from the tubular body 11. Each cone 27, 29 in addition to having a sloping surface 24, 26 for receiving a slip 31, 33, has a milled-out guide track or slot 28, 18 formed in the mid portion thereof and parallel to the longitudinal axis of tubular body 11 for receiving a guide portion 30 of the gripping means. The guide tracks 28, 18 as shown in FIG.'s 6 and 6A are cut the entire depth of the cones 27, 29 and include an upper retaining lip 16.

Figure 6:
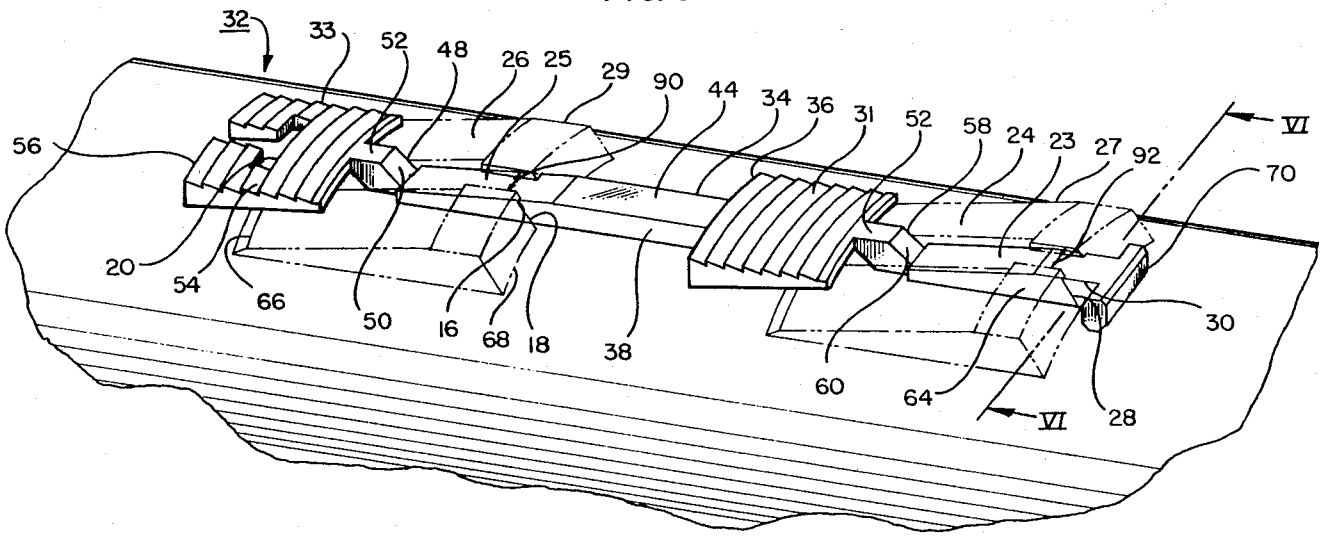
FIG. 6 is an isolated view of the gripping means of the universal liner hanger showing the connectors thereof.
Figure 6A:
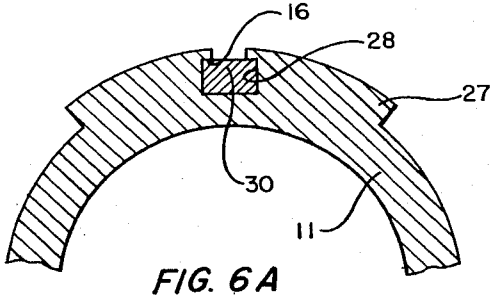
FIG. 6*a* is a partially broken away cross-sectional view of the universal liner hanger tubular body of FIG. 1 taken along lines VI—VI in FIG. 6.

The gripping means, designated generally as 32 in FIG. 6 is made up of three identical longitudinal bars 34, each of which is received within a respective aligned pair of cone guide tracks 18, 28. It should be understood that a greater or lesser number of longitudinal bars 34 could be used as well. Longitudinal bars 34 have spaced, integrally formed slip elements 31, 33 formed therein.

The leading slip 31 has a rear edge 36 which is joined to a generally rectangular mid section 38 which is adapted to be received within a guide track 18 milled out of cone 29. The top surface 44 of mid section 38 is joined by a downwardly sloping surface 25 to an extension 48 of the trailing slip 33. Extension 48 has an upwardly sloping portion 50 which is joined by a top surface 52 to slip 33. Slip 33 is generally wedge-shaped having a serrated outer surface 54 and a central "T"-shaped slot 20 formed in the lower edge 56 thereof.

Slip 31 is similar to slip 33 and has an extension 58 at the end thereof opposite rear edge 36. Extension 58 has a top surface 52 and downwardly sloping portion 60 similar to extension 48 which portion 60 is joined by an upwardly sloping portion 23 of an upper section 64 of the longitudinal bar 34. The upper section 64 of bar 34 is similar to mid section 38 and is adapted to be received within a guide track 28 in cone 27. Upper section 64 of bar 34 terminates in a "T"-shaped head connector 70 as best seen in FIG. 6.

As shown in FIG's. 6 and 6A, the guide portion 30 formed in the longitudinal bar 34 is suitably shaped to be slidingly received within the guide tracks 28, 18 in cones 27, 29. Also, the width of the guide portion 30 of the bars 34 is narrower at the sloping potions 60, 50 than at the ends of the sloping portions 23, 25 opposite the junction thereof with portions 60, 50. The width of sloping portions 60, 50 is selected to be narrower than the opening's 90, 92 in grooves 18, 28. The narrower width of sloping portions 60, 50 allows the bar 34 to be slidingly engaged on the exterior of the tubular body 11 by inserting the section 38 of bar 34 into the groove 28 and pushing the bar 34 in the direction of cone 29. In the running in position shown in FIG. 6, the retaining lips 16 hold the bar 34 inward against the tubular body 11. Because of the slope of the cones 27, 29, sliding movement of the guide portions 30 within the respective guide tracks 28, 18 caused by pulling on the "T"-head 70 or pushing on the "T"-slot 2 causes the spaced slip elements 31, 33 to ride up over the cone elements 27, 29 to move the slip elements radially outward to engage the surrounding casing.

Elongated tubular body 11 is adapted to engage interchangeable setting means on a selected one of the upper and lower connecting means 13, 15, the setting means being actuable to engage the pipe gripping slips 31, 33 with the expander means 27, 29 responsive to each of mechanical manipulation and fluid pressure. The interchangeable setting means is preferably actuable to engage the gripping means 31, 33 with the expander means 27, 29 responsive to actuation by a mechanism selected from the group consisting of a reciprocating sleeve, a hydraulic piston, a J-pin, and a setting tool. As shown in FIGS. 2–4*a*, a conventional liner tie back sleeve 35 normally engages the upper circumferential groove 19 in tubular body 11 when the reciprocating sleeve, hydraulic piston, and J-pin type interchangeable setting means are connected to the lower connecting means 15, of the tubular body 11. The tie back sleeve 35 is joined to the tubular body 11 by means of a collar 37. Collar 37 has a cylindrical base portion 42 with an inner shoulder 40 which is received within groove 19. An externally threaded ring 79 matingly engages internal threads in the tie back sleeve 35 to retain the collar 37 in place and thereby engage the tie back sleeve 35 and tubular body 11. The tie back sleeve 35 is "inoperable" in the sense that it does not move relative to the tubular body 11 to set the pipe gripping slips 31, 33. As shown in FIGS. 5 and 5*a*, a tie back setting sleeve 129 of the type used with a running tool setting mechanism can be connected to the lower circumferential groove 21 of tubular body 11. The tie back setting sleeve 129 is "operable" in the sense that it can be used with a conventional running tool setting mechanism to provide relative movement between the sleeve 129 and tubular body 11 for setting the pipe. When a tie back setting sleeve 129 is used with the elongated tubular body 11, a standard bottom connector sub 133 is connected to the lower connecting means 15 of tubular body 11.

Figure 2:
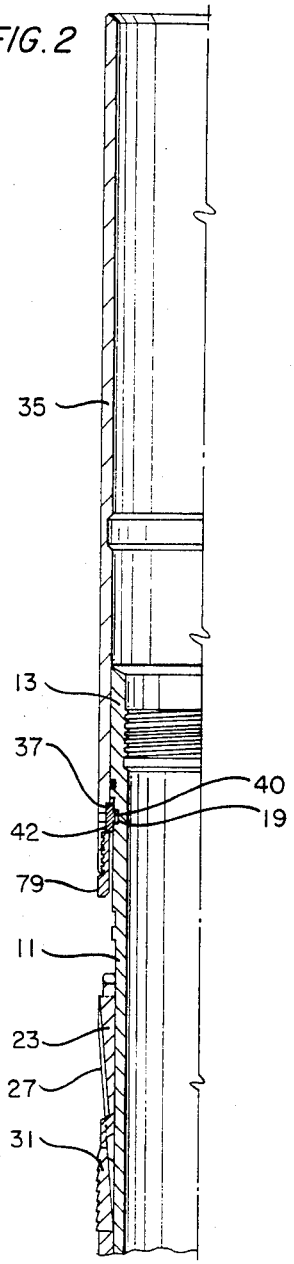
FIG. 2 is a side, partial cross-sectional view of the universal body of FIG. 1 with a liner tie back sleeve connected to the upper end thereof.
Figure 2A:
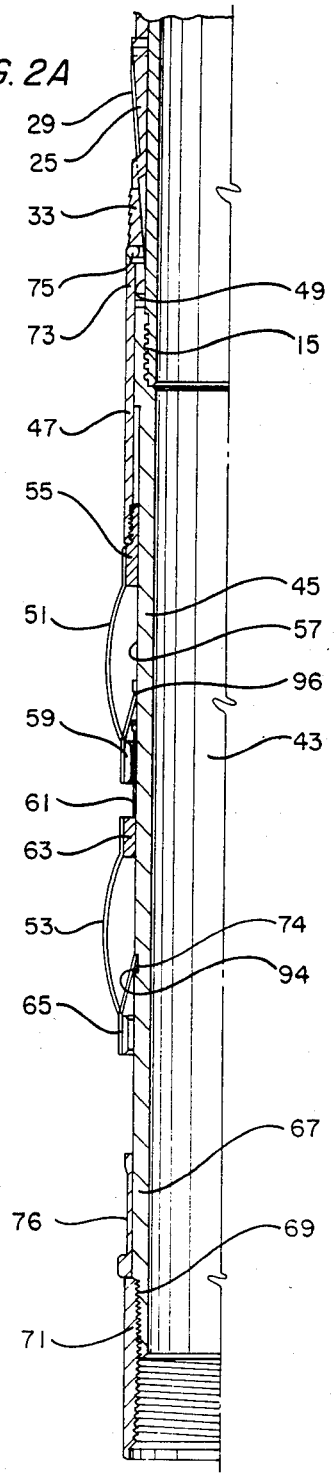
FIG. 2*a* is a side, partial cross-sectional view of the device of FIG. 2 showing the downward continuation thereof and showing a reciprocating sleeve setting mechanism connected to the lower end thereof.

Turning now to FIGS. 2 and 2*a*, the reciprocating sleeve setting configuration of the tool will be described in greater detail. As shown in FIG. 2, elongated tubular body 11 is run into position into the well bore with a tie back sleeve 35 in place which engages the upper circumferential groove 19 by means of collar 37. Tie back sleeve 35 and/or tubular body internally threaded upper end 13 can in turn be connected in a running string (not shown) which runs to the surface of the well bore.

Tubular body 11 has slip expander means 27, 29 extending circumferentially around the exterior of the tubular body 11 and gripping means 31, 33, for gripping engagement on the well bore casing as has been described. An interchangeable setting means comprising a tubular member 45 is connected to the lower connecting means 15 of tubular body 11 and extends downwardly therefrom. Tubular member 45 has an annular sleeve 47 slidably received on the exterior surface thereof. Tubular member 45 is connected to a spring ring 55 which is slidable on the exterior surface of member 45.

Drag springs 51, 53 on tubular member 45 below annular sleeve 47 provide sufficient frictional force to allow the tubular member 45 to be shifted longitudinally or "stroked" relative to annular sleeve 47. Drag spring 51 connects spring ring 55 to a sliding spring retainer 59 which is connected by means of sleeve 61 to upper spring retainer ring 63 of spring 53. The lower end of spring 54 is connected to a lower spring retainer 65.

Spring retainer 65 includes a dog member 74 which, as shown in FIG. 2A, is received in a stop groove 94 on the exterior of tubular members 45. The construction of dog member 74 allows the tubular member 45 to be shifted upward relative to sleeve 47 but resists relative movement in the opposite sense. However, once the tubular member 45 is stroked upwardly far enough to engage and pick up trip ring 76, downward movement of the tubular member 45 relative to the sleeve 47 results in dog member 74 and trip ring 76 riding over the stop groove. This movement also allows sleeve 61 to ride upward under a second dog member 96 which, in turn, allows the dog member 96 to ride over the stop groove 94. This allows the upper end 73 of sleeve 47 which is engaged to slip 33 by the T-head connection 75 to move the gripping means 31, 33 upwardly along the expander means 27, 29 to set the slips. The up and down movement which has been described is referred to as a reciprocating set.

The bottom end 67 of tubular member 45 has an externally threaded surface 69 on which is received a bottom sub connection 71. Connector sub 71 can be the top section of a liner to be hung in the well bore or can comprise means for connection to the liner.

The operation of the reciprocating sleeve setting mechanism will now be described in greater detail. Tubular body 11 is run into position in the well bore as shown in FIG. 2 on tie back sleeve 35. Once the tool is positioned at the desired location in the well bore, the pipe string is pulled upwardly from the surface to shift tubular member 45 relative to sleeve 47. The frictional resistance provided by springs 51, 53 acting against the side of the well bore or casing holds annular sleeve 47 in place bringing lower spring retainer 65 over trip ring 76 and sleeve 61 under upper spring retainer 59. Setting weight down on the pipe string from the surface now shifts member 45 downwardly relative to sleeve 47. The greater relative movement allowed by dog members 74, 96 riding over the stop groove 94 allows the upper end 73 of annular sleeve 47 to apply an upward force to gripping slip 33 thereby engaging gripping slips 31, 33 with expander means 25, 23 to cause slips 33, 31 to be extended outwardly into gripping engagement with the surrounding casing.

Figure 3:
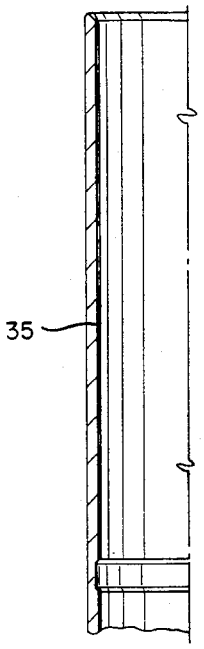
FIG. 3 is a side, partial cross-sectional view of a liner tie back sleeve similar to that shown in FIG. 2.
Figure 3A:
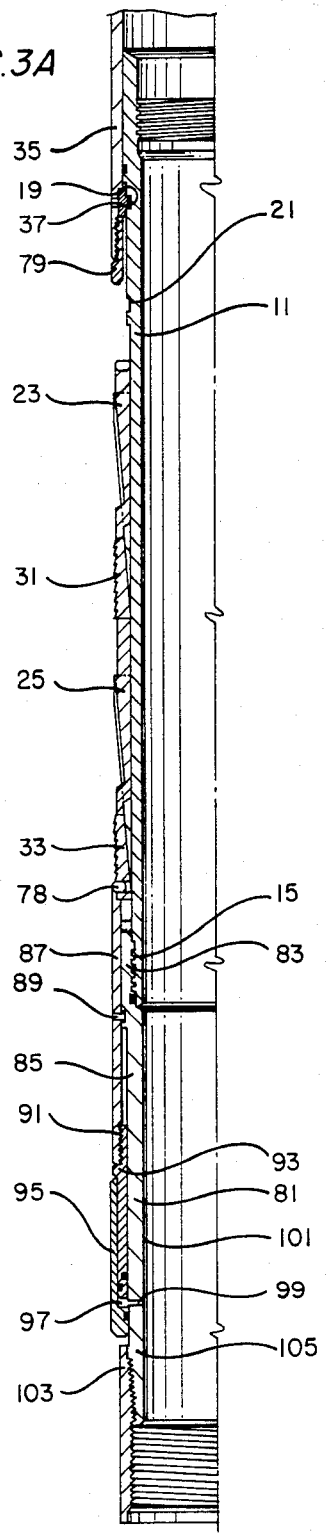
FIG. 3*a* is a side, partial cross-sectional view of the device of FIG. 3 showing the downward continuation thereof and showing the universal hanger body with a hydraulically actuated setting mechanism connected to the lower end thereof.

Turning now to FIGS. 3 and 3*a*, the hydraulic piston actuated setting mechanism for the universal liner hanger tool will now be described. Tubular body 11 is once again run into position with a tie back sleeve 35 in place which is connected at upper circumferential groove 19, collar 37 as has been previously described. Collar 37 is held in place by an externally threaded retainer ring 79 which threadedly engages the interior surface of the lower end of the tie back sleeve 35.

Tubular body 11 is identical to that previously described in FIGS. 1, 2, and 2*a*. In the configuration shown in FIG. 3*a*, however, a hydraulic piston actuated setting mechanism 81 has an internally threaded upper end 83 which threadedly engages the lower connecting means 15 of tubular body 11. The setting means 81 comprises a tubular member 85 having an annular sleeve 87 slidably received on the upper end thereof. Sleeve 87 is initially connected to the external surface of upper end 83 by means of a shear pin 89. The lower end 91 of annular sleeve 87 is threadedly connected to the upper end of a hydraulic piston member 93. Piston member 93 is a ring-shaped member slidably received between the exterior surface of tubular member 85 and a surrounding cylindrical body 95 which is fixedly connected to the lower end of member 85. The internal diameter of cylindrical body 95 is such that piston 93 is slidably received between body 95 and tubular member 85 with a space 97 left at the lower end thereof which communicates by means of a port 99 with the internal diameter 101 of member 85. An internally threaded connector sub 103 is connected to the externally threaded connection 105 of member 85. Connector sub 103 can be the top section of a liner to be hung in the well bore or can comprise means for connection to the liner.

Operation of the hydraulic piston actuated setting means for the universal liner hanger tool will now be described. The tubular body 11 is run into position in the well bore with tie back sleeve 35 in place. Once the desired depth and location have been reached, the internal bore of the pipe string below port 99 is closed using known techniques, such as by dropping a ball into a ball catching sub (not shown). The tubing string is then pressured up with an appropriate fluid from the surface and the fluid acts through port 99 on the lower side of hydraulic piston 93 causing shear pin 89 to shear. Once the predetermined increase in internal pressure in the tubing string has sheared pin 89, annular sleeve 87 is allowed to shift upwardly relative to tubular member 11 and acts through the "T"-head connection 78 to engage the gripping means 31, 33 with the expander means 27, 29 to grip the well casing.

Figure 4A:
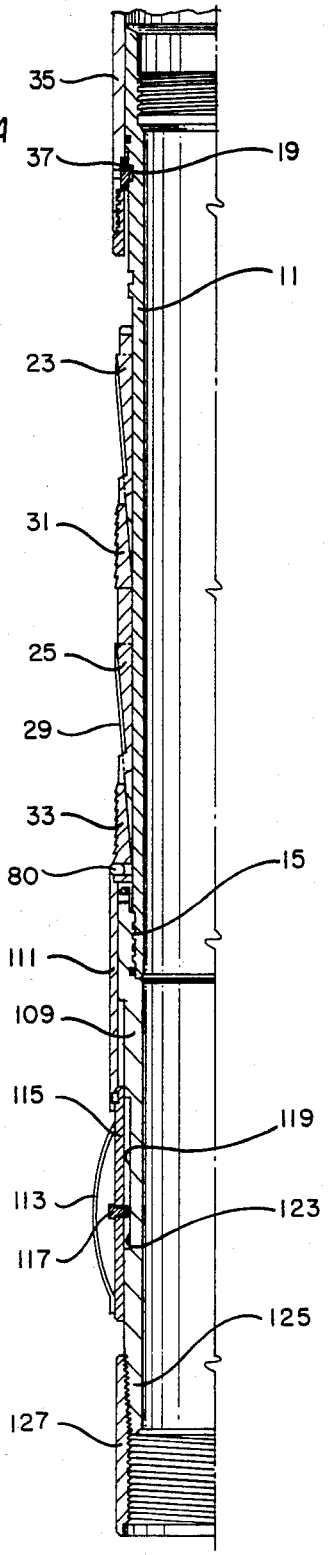
FIG. 4*a* is a side partial cross-sectional view of the device of FIG. 4 showing the downward continuation thereof and showing the liner hanger body with a J-pin actuated setting mechanism connected to the lower end thereof.
Figure 4:
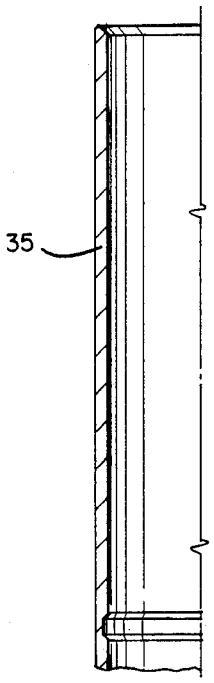
FIG. 4 is a side, partial cross-sectional view of a liner tie back sleeve similar to FIG. 3.
Figure 5:
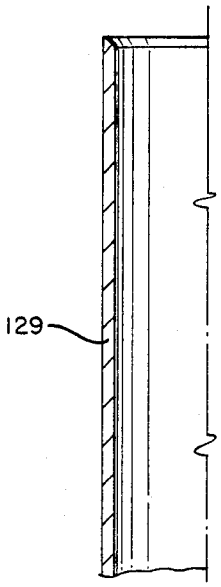
FIG. 5 is a side, partial cross-sectional view of a tie back setting sleeve of the type used with a running tool setting mechanism.
Figure 5A:
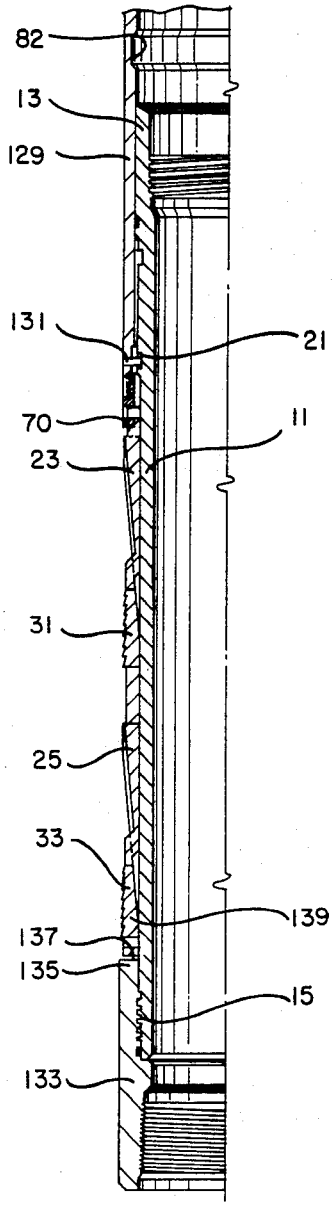
FIG. 5*a* is a downward continuation of FIG. 5 showing the universal hanger body connected to the tie back setting sleeve, the universal body having a standard internally threaded connector sub connected to the lower end thereof.

FIGS. 4 and 4*a* shows the J-pin actuated setting mechanism for the universal liner hanger tool. The tubular body 11 is once again run into position with a tie back sleeve 35 in place having a collar 37 which engages the upper circumferential groove 19 in tubular body 11 as previously described. Tubular body 11 is identical to that shown in FIG. 1 and has gripping means 31, 33 and slip expander means 27, 29. The J-pin actuated setting mechanism comprises a tubular member 109 connected to the lower connecting means 15 of tubular body 11 and extending downwardly therefrom. Tubular member 109 has an externally threaded lower end 125 which is engaged by a bottom connector sub 127 which can form the upper portion of the liner string to be hung. Tubular member 109 has an annular sleeve 111 slidably received on the exterior surface thereof. As shown in FIG. 4*a*, annular sleeve 111 has a lower extension 115 connected thereto which carries a transverse pin 117. Pin 117 is received within a longitudinal slot 119 for sliding movement therein which slot has a J portion 123 at the lower end thereof for receiving pin 117 in the known manner. J-pin mechanisms are known in the art and are shown, for example, in U.S. Pat. No. 3,195,645 to C. C. Brown. Lower extension 115 has drag means comprising bow spring 113 carried for resisting longitudinal travel of sleeve 111 in the well bore.

The operation of the J-pin actuated setting mechanism will now be described. The tubular body 11 is first run into position in the well bore with a tie back sleeve 35 in place. Once the desired depth and location have been reached, the pin 117 is moved from the J-portion into slot 119 by rotating the liner running tool from the surface. Pin 117 is then free to move longitudinally within slot 119 as weight is set down on the tubing string from the surface. Drag means 113 resist longitudinal movement of sleeve 111 in the well bore thereby allowing tubular body 11 to shift relative to annular sleeve 111 to contact pipe gripping means 33 with expander means 29 to set the slips. Sleeve 111 is once again joined to slip 33 by a "T"-head connection 80.

Turning now to FIGS. 5 and 5*a*, there is shown the running tool actuated setting mechanism for the universal liner hanger tool. Tubular body 11 has a tie back setting sleeve 129 connected by means of a frangible connection 131 to lower circumferential groove 21. The tie back setting sleeve 129 has a "T"-slot at the lower end thereof which engages the "T"-head 70 of the gripping means. The tie back setting sleeve 129 also has an annular groove 82 in the interior thereof. The lower connecting means 15 of tubular body 11 has a bottom connector sub 133 threadedly engaged thereon. Connector sub 133 has an upper extent 135 which forms a ledge 137 which is located adjacent the lower end 139 of gripping means 33 in the position shown. Connector sub 133 can be the top section of a liner to be hung in the well bore or can comprise means for connection to the liner.

The operation of the running tool actuated setting mechanism will now be described. The tubular body 11 is first run to the desired depth and location in the well bore. A conventional running tool setting mechanism (not shown) would be engaged on the threaded upper end 13 of tubular body 11 and on the annular groove 82 in tie back setting sleeve 129. By appropriate manipulation of the running tool, the frangible connection 131 is sheared allowing the tie back setting sleeve 129 to be shifted upwardly relative to tubular body 11. Since tie back setting sleeve 129 has a "T"-head slot which engages the slip "T"-head connector 70, the gripping means is moved upwardly to cause slips 31, 33 to ride up on cones 27, 29.

The running tool setting mechanism has been discussed in its simplest form and any of a number of running tool setting mechanisms can be utilized to practice the invention. A suitable running tool which can be used with the tie back setting sleeve 129 is shown, for instance, in U.S. Pat. No. 3,608,634 to Cochran, issued Sept. 28, 1972, entitled "Hydraulic Set Liner Hanger".

Comparing FIG.'s 5 and 5A to FIG.'s 2–4A, it can be seen that in the reciprocation set, hydraulic piston, and J-pin setting mechanisms, the gripping means is pushed upwardly from the lower slip end 33. In the running tool setting mechanism of FIG.'s 5 and 5A, the setting mechanism is pulled upwardly from the upper slip end 31. In both cases, the tubular body 11, gripping means and expander means are identical.

An invention has been provided with significant advantages. The universal liner hanger tool of the invention comprises a universal body with upper and lower connecting means for connecting interchangeable setting means. The universal tool has a greater number of common parts than prior designs, thereby reducing the manufacturing costs and replacement part inventory needed. The universal tool is more versatile than prior designs in that the tool can accommodate all of the basic setting mechanisms depending upon the particular situation encountered at the well site.

I claim:

1. A hanger mechanism for a liner hanger of the type used to hang liners in a well bore, comprising:

an elongated tubular body;

at least two longitudinally spaced sets of cone elements extending circumferentially around the exterior of said tubular body;

one or more slip units, each of said slip units having at least a leading and a trailing spaced slip element connected by an intermediate longitudinal bar, said leading slip element having a rear edge joined to a generally rectangular midsection of said longitudinal bar, and said longitudinal bar having a guide portion adapted to be slidingly received within a guide track formed in selected ones of said cone elements on the exterior of said tubular body, said guide tracks including an upper retaining lip for holding said longitudinal bar inward against said tubular body as said slip elements move over said cones; and wherein said guide portion of said intermediate longitudinal bar has a lower surface in contact with said tubular body, opposing side surfaces and a top surface, said top surface being joined by a downwardly sloping surface to an extension of said trailing slip, said trailing slip extension having an upwardly sloping portion which connects said downwardly sloping surface to a top surface of said trailing slip, whereby sliding movement of said guide portions within the respective guide track causes said spaced slip elements to ride over said longitudinally spaced cone elements to move said slip elements radially outwardly to engage the well bore.

2. The hanger mechanism of claim 1, wherein said guide tracks are formed in the mid portion of said cones and run parallel to the longitudinal axis of said tubular body.

3. The hanger mechanism of claim 2, wherein said spaced slip elements are integrally formed in said longitudinal bars of single piece construction.

4. The hanger mechanism of claim 3, wherein said longitudinal bars are provided with connector means at either end thereof for engaging a setting means to move said slip elements along said cone elements to engage the well bore.

* * * * *